US007147535B2

(12) United States Patent
Simeray

(10) Patent No.: US 7,147,535 B2
(45) Date of Patent: Dec. 12, 2006

(54) OPTICAL REMOTE CONTROLLER POINTING THE PLACE TO REACH

(76) Inventor: Janick Simeray, 58 rue Henri Barbusse, 95100 Argenteuil (FR)

( * ) Notice: Subject to any disclaimer, the term of this patent is extended or adjusted under 35 U.S.C. 154(b) by 436 days.

(21) Appl. No.: 10/426,611

(22) Filed: Apr. 29, 2003

(65) Prior Publication Data

US 2003/0228916 A1 Dec. 11, 2003

(30) Foreign Application Priority Data

Jun. 11, 2002 (FR) ..... 02 07126
Feb. 3, 2003 (FR) ..... 03 01182

(51) Int. Cl.
*A63H 30/04* (2006.01)
*A63H 17/32* (2006.01)
*A63H 17/385* (2006.01)

(52) U.S. Cl. ..... 446/175; 446/454; 446/465

(58) Field of Classification Search ..... 463/62, 463/63; 434/62, 63; 446/175, 85, 94, 95, 446/96, 438, 443, 444, 448, 451, 454, 457, 446/460, 462, 465, 468, 496, 470
See application file for complete search history.

(56) References Cited

U.S. PATENT DOCUMENTS

| | | | | |
|---|---|---|---|---|
| 3,130,803 | A | 4/1964 | Wiggins | |
| 3,314,189 | A * | 4/1967 | Carroll | 446/175 |
| 3,366,862 | A * | 1/1968 | Beck et al. | 388/855 |
| 3,406,481 | A * | 10/1968 | Ichiro | 446/175 |
| 3,657,695 | A * | 4/1972 | Birmingham | 340/431 |
| 3,849,931 | A * | 11/1974 | Gulley, Jr. | 446/175 |
| 4,201,012 | A * | 5/1980 | Marshall | 446/175 |
| 4,232,865 | A | 11/1980 | Chen et al. | |
| 4,310,987 | A * | 1/1982 | Chieffo | 446/458 |
| 4,662,854 | A * | 5/1987 | Fang | 446/175 |
| 4,828,525 | A * | 5/1989 | Okano | 446/175 |
| 4,865,575 | A * | 9/1989 | Rosenthal | 446/175 |
| 4,987,349 | A * | 1/1991 | Nakamura | 318/293 |
| 5,127,658 | A * | 7/1992 | Openiano | 463/50 |
| 5,630,743 | A * | 5/1997 | Shi | 446/175 |
| 5,723,855 | A * | 3/1998 | Oh et al. | 250/206.1 |
| 6,062,943 | A * | 5/2000 | Maleika | 446/444 |
| 6,482,064 | B1 * | 11/2002 | Lund | 446/175 |
| 6,590,222 | B1 * | 7/2003 | Bisset et al. | 250/559.29 |
| 6,814,643 | B1 * | 11/2004 | Dooley et al. | 446/175 |
| 6,827,167 | B1 * | 12/2004 | Cikanek et al. | 180/65.6 |
| 6,939,192 | B1 * | 9/2005 | Munch et al. | 446/91 |

(Continued)

FOREIGN PATENT DOCUMENTS

DE 2006570 8/1971

(Continued)

OTHER PUBLICATIONS translation of German patent document DT 2 006 570, "Steering Device for Light-Controlled Driving Toys with Wheel Drive," Carlheinz Moeder, A63H30/04, application date Feb. 13, 1970, publication date Aug. 26, 1971.*

(Continued)

*Primary Examiner*—Xuan M. Thai
*Assistant Examiner*—Matthew D. Hoel
(74) *Attorney, Agent, or Firm*—Kenyon & Kenyon LLP

(57) ABSTRACT

A motorized mobile toy remote controlled by light beams. The remote control projects a spot on the ground, the toy, equipped with optical sensors, follows the spot. The optical sensor delivers instructions on the variation of the position of the spot compared to the center of the image, the processing of an electronic circuit then controls the motors to compensate the variation.

17 Claims, 12 Drawing Sheets

U.S. PATENT DOCUMENTS

| | | | | |
|---|---|---|---|---|
| 2001/0053650 | A1 | 12/2001 | Simeray | |
| 2002/0102910 | A1* | 8/2002 | Donahue et al. | 446/465 |
| 2003/0082987 | A1* | 5/2003 | Baumgartner et al. | 446/175 |
| 2004/0229696 | A1 | 11/2004 | Beck | |
| 2005/0042971 | A1* | 2/2005 | Dooley et al. | 446/175 |

FOREIGN PATENT DOCUMENTS

| | | | |
|---|---|---|---|
| EP | 0 878 926 | A2 * | 11/1998 |
| FR | 2 684 892 | A1 * | 6/1993 |
| FR | 2789907 | | 8/2000 |
| GB | 946123 | A | 1/1964 |
| GB | 1354676 | | 5/1974 |
| GB | 2 274 522 | A * | 7/1994 |
| JP | 04135213 | | 5/1992 |
| WO | WO 00/45925 | * | 8/2000 |

OTHER PUBLICATIONS

Dawson, M., Minds and Machines: Connectionism and Psychological Modeling; retrieved Oct. 31, 2005 from http://www.bcp.psych.ualberta.ca/~mike/book2/robots/vehicles/.
Dogus Day (2002); retrieved Nov. 9, 2005 from http://techtree.com/techtree/jsp/article.jsp?article_id=46808&cat_id=618.
International Search Report for PCT/EP03/07128.
Les vehicules de Braitenberg, retrieved Oct. 31, 2005 from http://www.vieartificielle.com/article/index.php?action=article&id=27.
Mega-Byte, retrieved Nov. 9, 2005 from http://www.e-clec-tech.com/megabyterc.html.
Smart Talking Tractor and Trailor Truck by BAO, retrieved Oct. 31, 2005 from http://shop.store.yahoo.com/the-eggshop/smtatrbybao.html.
Smart Talking Tractor and Trailor Truck by BAO, retrieved Oct. 31, 2005 from http://personalbargins.com/the-eggshop/smtatrbybao.html.
Smart Talking Tractor and Trailor Truck by BAO, retrieved Oct. 31, 2005 from http://homestore3.com/smtatrbybao.html.
Smart Talking Truck with 4 Cars; retrieved Oct. 31, 2005 from http://www.winmallyahoo.com/smartaltrucw.html.
Smart Talking Truck with 4 Cars; retrieved Oct. 31, 2005 from http://www.tfnutrition.com/smartaltrucw.html.
Smart Talking Truck with 4 Cars; retrieved Oct. 31, 2005 from http://shop.store.yahoo.com/winmarte/smtatrwi4ca.html.
Smart Talking Truck with 4 Cars; retrieved Oct. 31, 2005 from http://winmarte.com/smtatrwi4ca.html.
The Smart Talking Tractor and Trailor Truck by BAO, retrieved Oct. 31, 2005 from http://home-and-hardware.com/smtatrbybao.html.
The Smart Talking Tractor and Trailor Truck by BAO, retrieved Oct. 31, 2005 from http://fedderhead.com/smtatrbybao.html.
The Smart Talking Tractor and Trailor by BAO, retrieved Oct. 31, 2005 from http://eggshop.net/smtatrbybao.html.
The Smart Talking Tractor and Trailor by BAO, retrieved Oct. 31, 2005 from http://eggshopstore.com/the-nutrionist/smtatrbybao.html.
Picture of My Magic Truck (1).
Picture of My Magic Truck (2).
Picture of My Magic Truck (3).
Robopet™ User's Manual.
Robosapien User's Manual.
Roboraptor™ User's Manual.
Wiseman, J. (1999), Braitenberg Vehicles; retrieved Oct. 31, 2005 from http://people.cs.uchicago.edu/~wiseman/vehicles/.

* cited by examiner

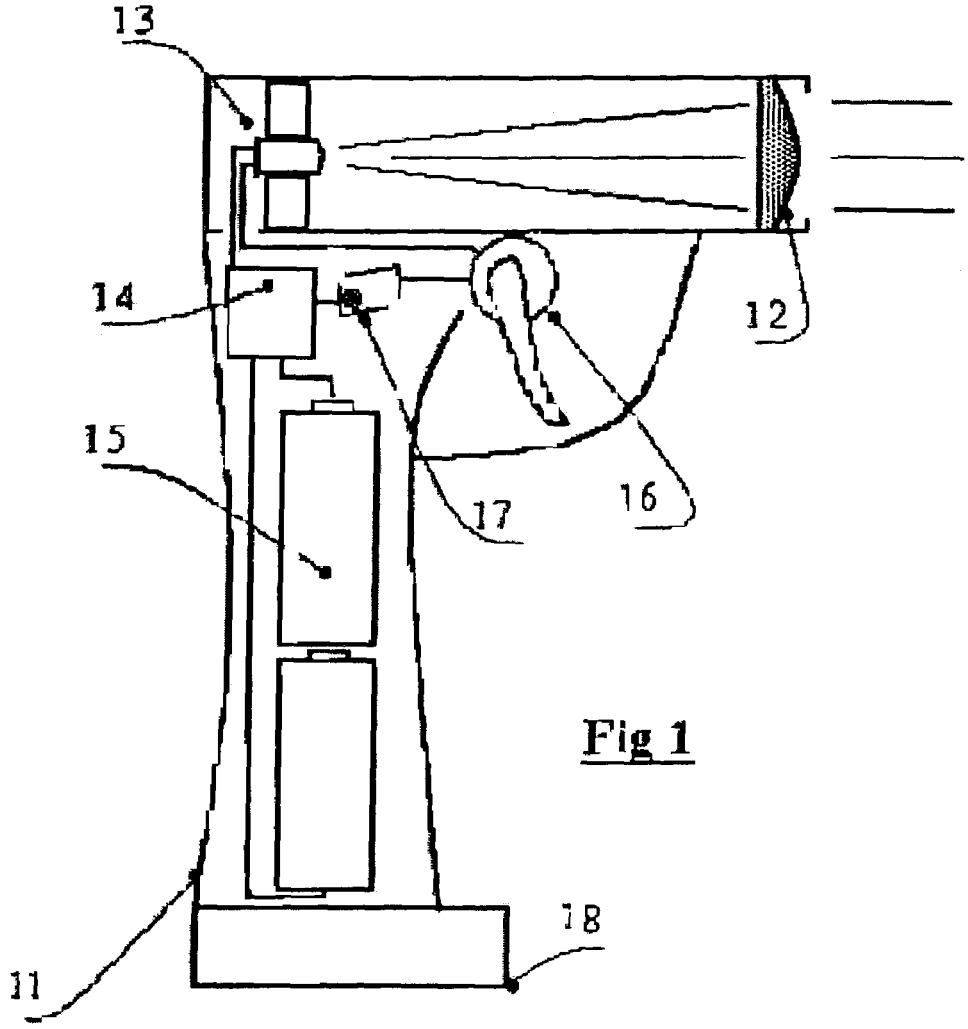
Fig 1
Fig 2
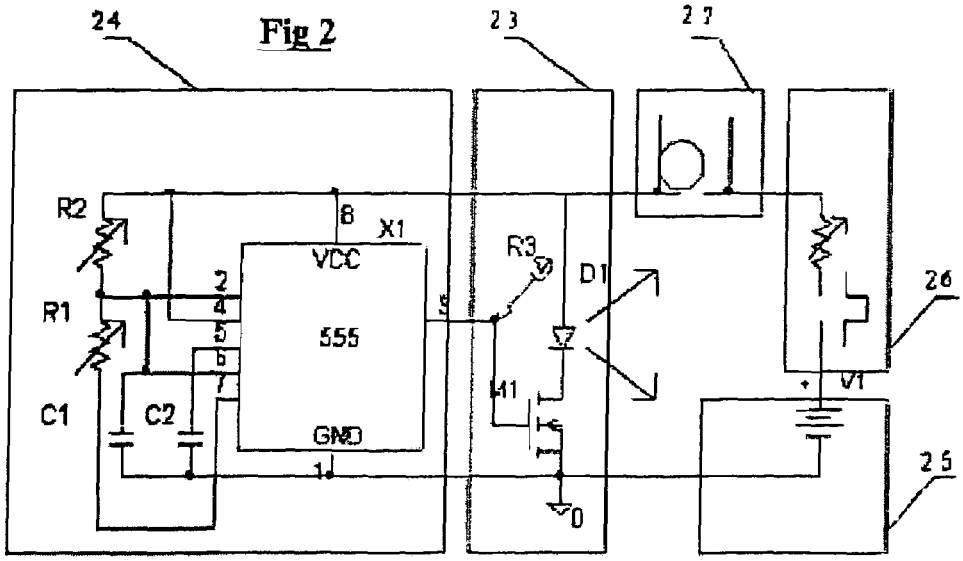

FIG 9
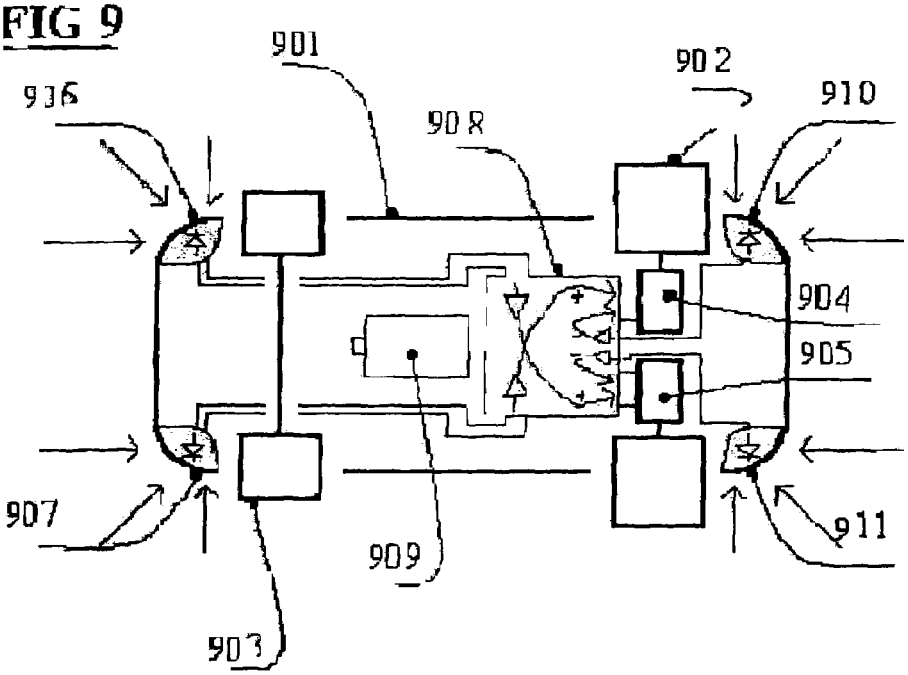
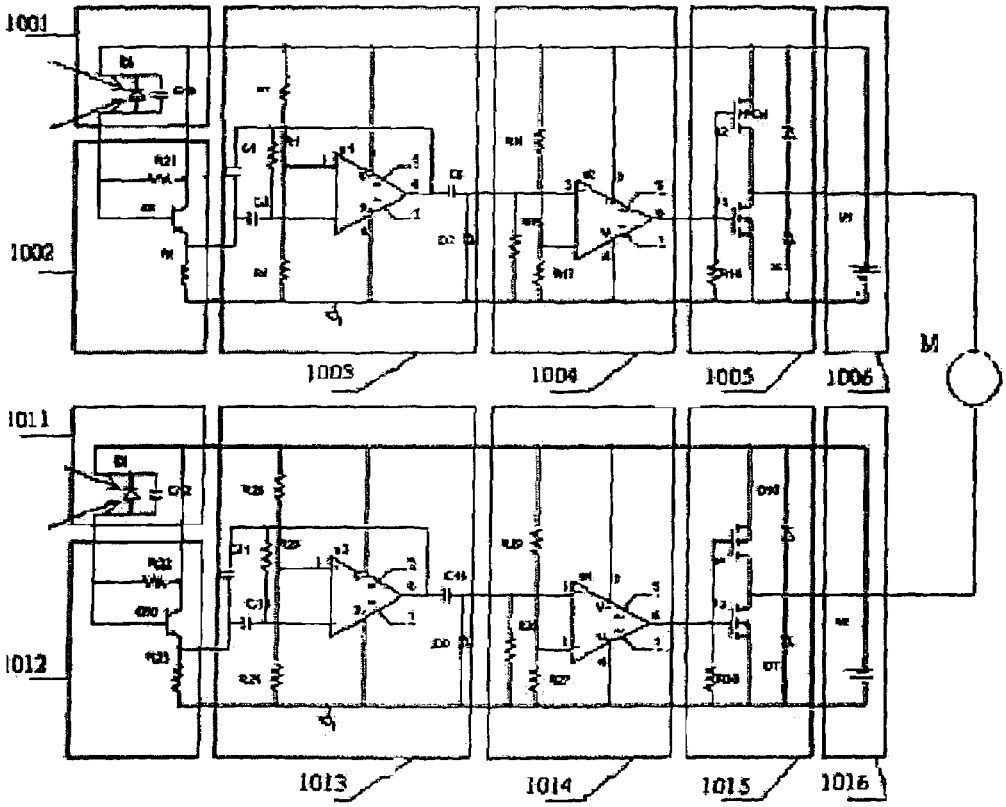
Fig 10

Fig 11
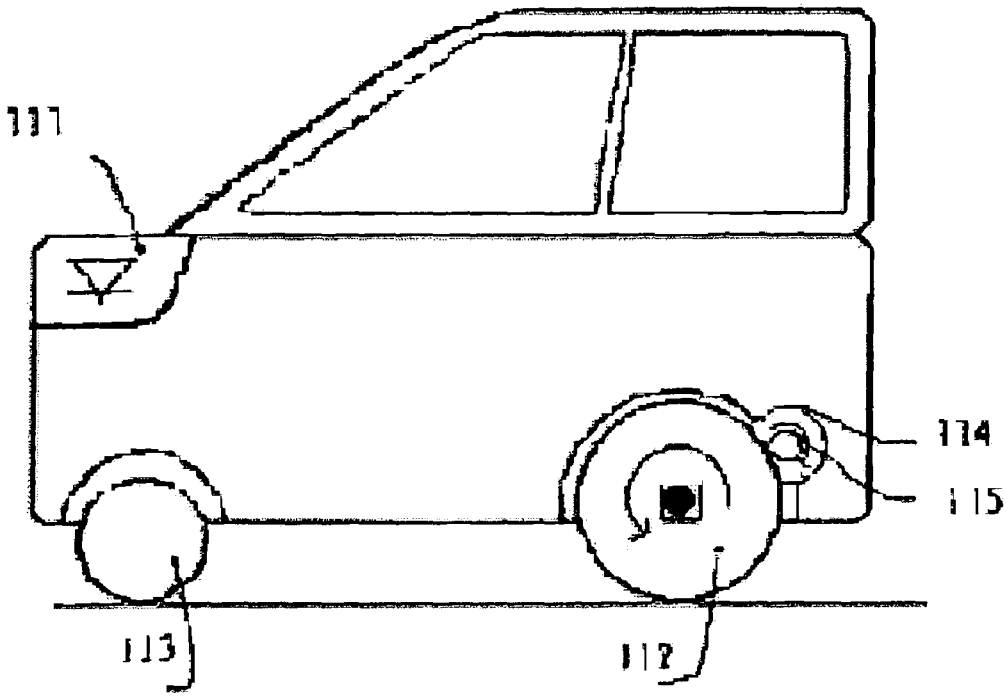
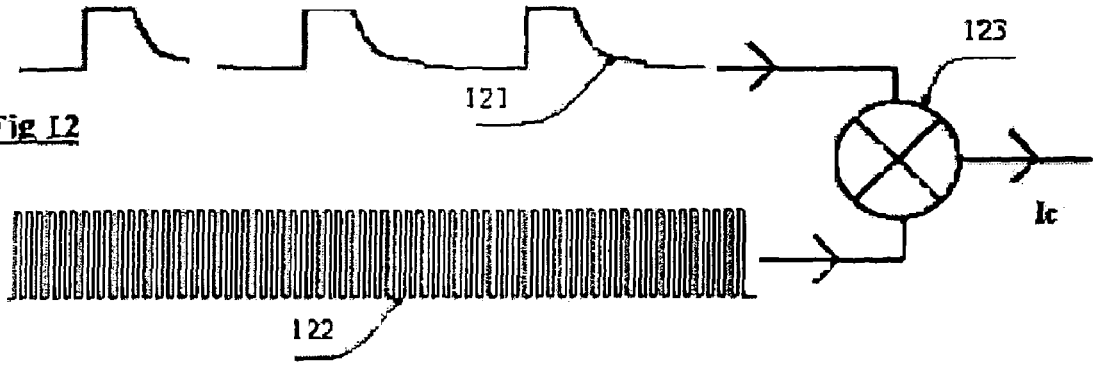
Fig 12
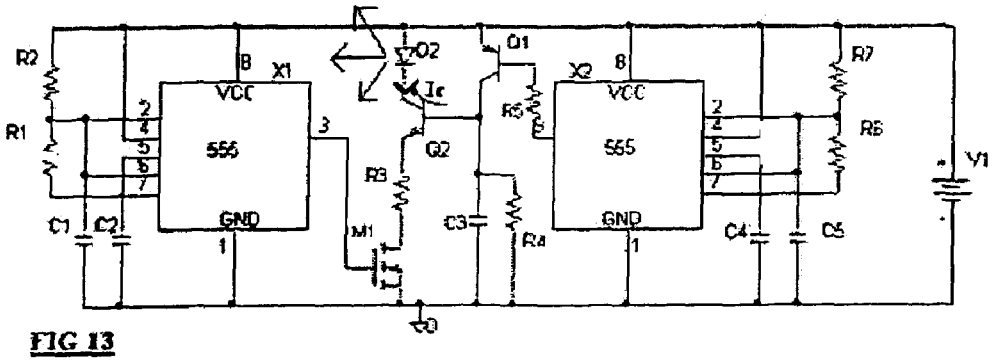
FIG 13

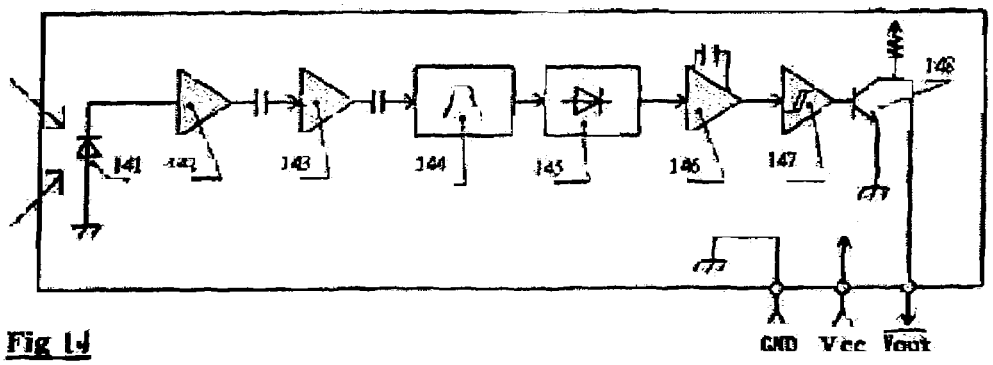
Fig 14
FIG 15
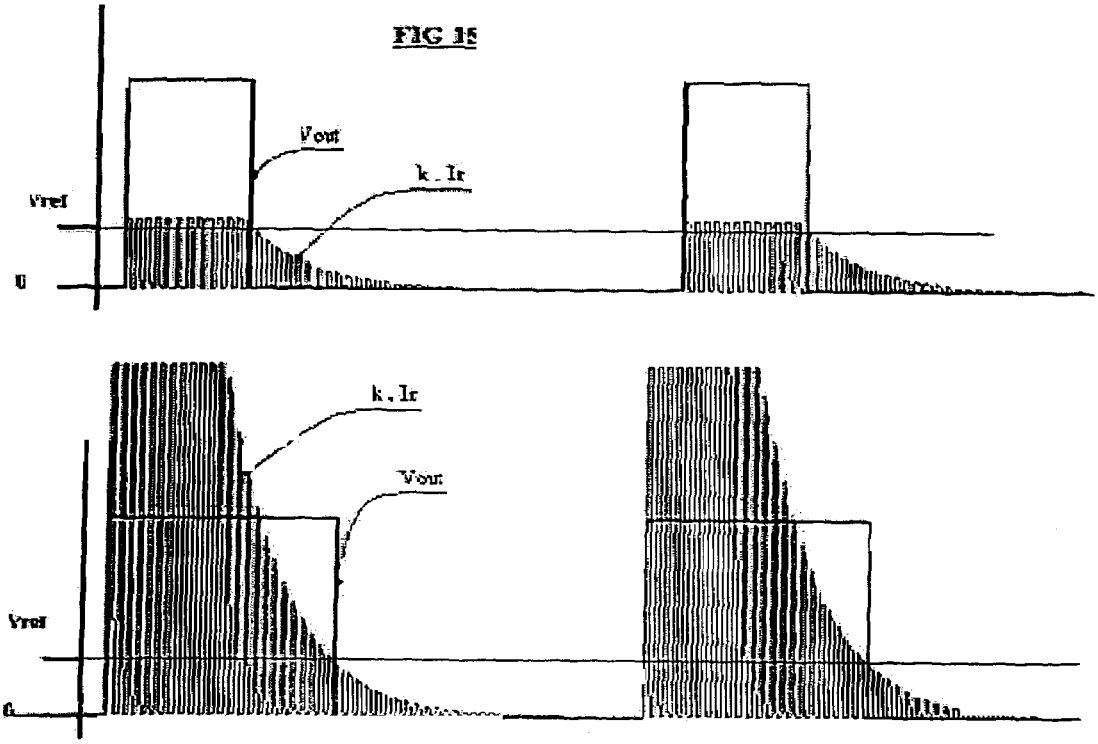

Fig 16
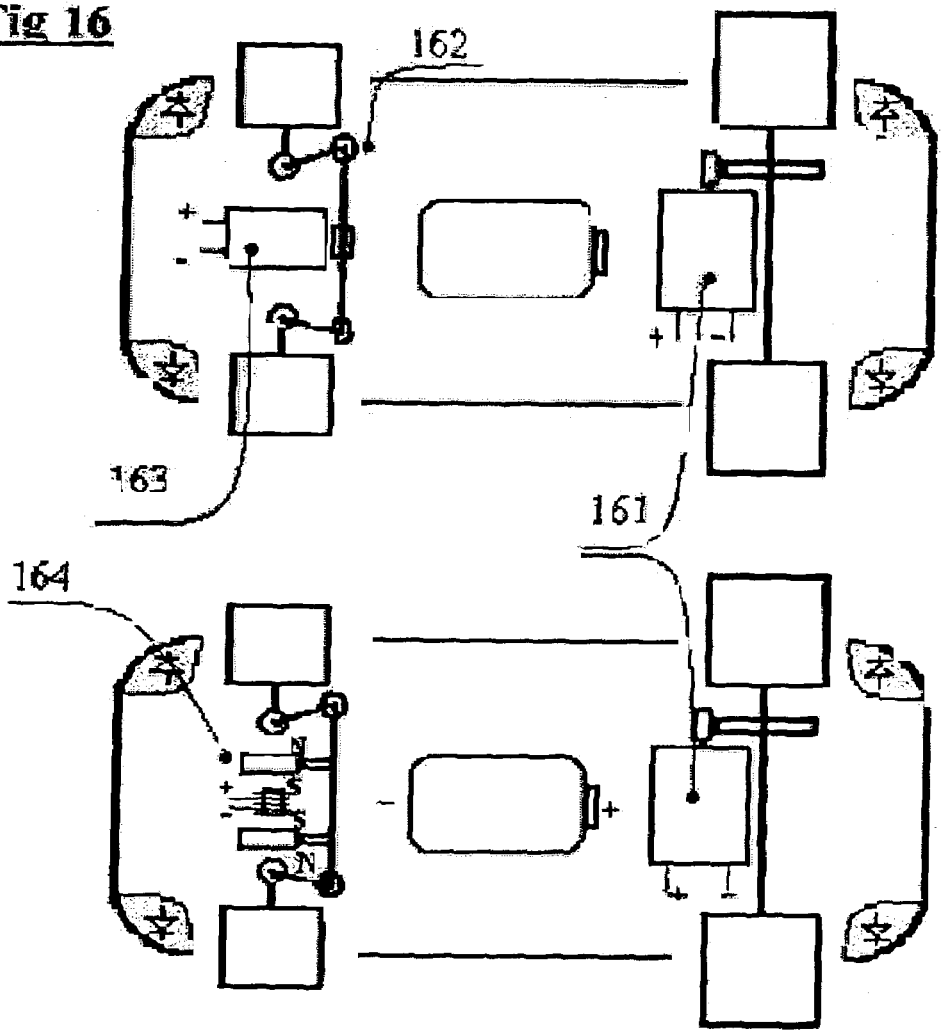
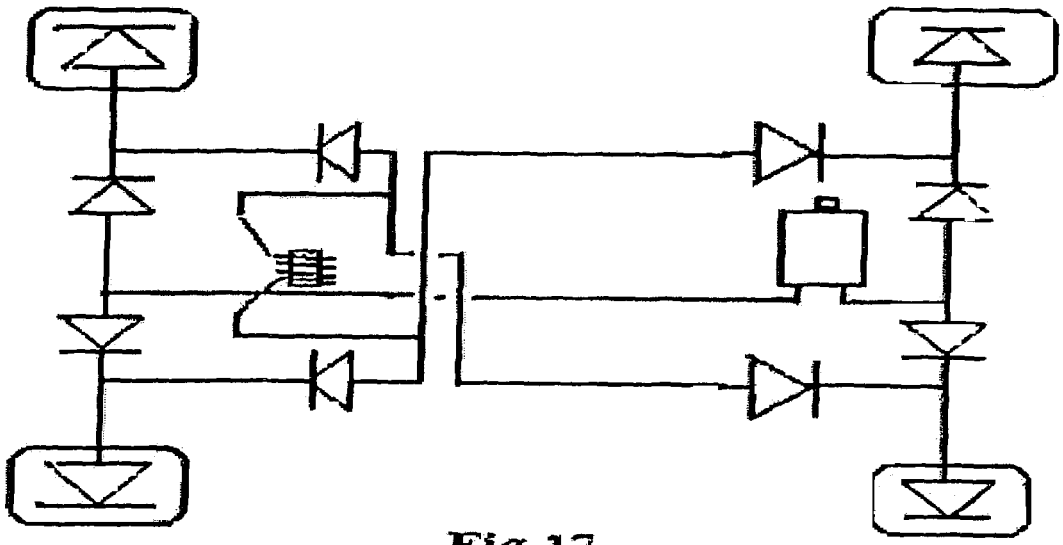
Fig 17

OPTICAL REMOTE CONTROLLER POINTING THE PLACE TO REACH

FIELD OF INVENTION

The present invention relates to a motorized and remote controlled mobile toy, whose remote control is ergonomic and simplified and is adapted to used by a very young child.

BACKGROUND INFORMATION

There are many kinds of remote controls, both radio wave and infrared based. These remote controls particularly emit instructions of acceleration or direction in the direction of the motorized toy. These instructions are interpreted by the vehicle, according to its own instantaneous position. The user must take this position into account, however, to be able to control the toy. These typical controls are not very acceptable for a child. Turning right is intuitive when the vehicle moves away from the child, but when the vehicle comes back to the child, the controls are reversed.

These remote controls are not reactive, hence they do not take into account the changes of path adherence of the toy and the difficulty to modulate the acceleration. There is a need to solve these restraints, and to propose an intuitive remote control immediately controlled by the child and adapted to his/her limit:

German Published Patent Application No. DE 2 006 570 TO describes a toy which has three detectors pointed at the top, wherein L1 controls the M1 left engine and L2 the M2 engine. The two engines are constantly power supplied through a button on the toy. When a detector is lighted, the corresponding engine is stopped. Because the other engine is still working, the toy turns in the lighted sensor direction. The user has to point the sensor which transmits an on/off binary order. A detector L4 puts in support a wheel which direction is clear, in order to make rotation easier. The toy has optical sensors pointed at the top with engines. The user runs after the toy throwing a beam, precisely on a sensor, to transmit the stop setting off order of the motorized wheel. This will turn the toy into the side of the lighted sensor.

The toy does not detect and follow a bright spot projected on the ground by the user optical control, till joining its center, through optical sensors oriented to the ground, which order the propulsion and direction engines speed, proportionally to the intensity of the flow of the spot caught by these sensors, and this without influence of the ambient bright environment.

U.S. Pat. No. 3,130,803 describes a vehicle having two optical sensors oriented to the ground delivering an order proportional to the optical flow caught, and at least two engines, in order to follow a trajectory materialized by a bright strip. The optical signal received on each sensor is directly increased and delivered to the engine without filter, so that each engine speed is proportional to the ambient light intensity and to the diffusing area. The path line regulates the trajectory of the toy, but not its speed. Thus, the toy is not optically remote controlled, but has a trajectory which is programmed by the path line. Furthermore, the toy does not have a command system which is light ambient level non-sensitive U.S. Pat. No. 4,232,865 describes a mobile toy remote controlled by a visible or infra-red beam emission pulse-wave modulated on the toy sensors up-oriented. The command system transmits a signal (delay between two impulses). It is processed by the toy as a pre-scheduled move order. The user goes after the mobile toy to disturb the toys trajectory. The toy has a remote-controlled system of motorized mobile toy's movements, based on a modulated light emission received by up-oriented sensors. The moves are orders which are pre-scheduled in time-delay and intensity, and not a progressive move depending on the received optical flow, in a direction relative to the spot position and to the vehicle.

United Kingdom Published Patent No. GB1354676 describes an interactive toy composed by an optical, tactile and sound system driving sensors setting off a command system relay on at least 2 engines.

U.S. Pat. No. 3,406,481 describes a toy with a driving wheel set on a vertical axle which is oriented by a modulated beam action thrown on at least two photoelectric receivers fixed with this turning axle. The wheel and the sensors are spontaneously oriented to equilibrate the received flows on the two receivers. It is a toy optically remote-controlled by a modulated beam which is thus differentiated from the ambient light. For changing the direction of the vehicle, it is necessary to change the modulated light source. The toy automatically follows the user who is the carrier of the source. The toy does not follow a spot on the floor projected by an optical remote control which points at the area to reach. A directional system is composed of two photovoltaic sensors motorized by the action of the level difference between the receptions.

SUMMARY

According to the invention, a child may use a manual control as illustrated in FIG. 1. This control emits a collimated optical beam which projects a spot on the floor. The spot generated by this control indicates the area that the motorized vehicle must reach. The vehicle detects, follows and reaches the spot, wherein the child simply defines the trajectory that the vehicle must cover.

According to a first exemplary embodiment of the invention, the vehicle comprises at least two motors driving two wheels, an autonomous source of energy (for example batteries), which supplies an electronic circuit of the motor control, wherein this electronic circuit receives information on the relative position of the spot. This electronic circuit controls the motors to move the vehicle forward if the spot moves away, in the axis of the vehicle to turn the vehicle in the relative lateral direction which the spot takes.

In an another exemplary embodiment of the present invention, the spot projected on the rear end of the vehicle controls a backward motion and then a complete turning over of the vehicle. The sensors, which deliver information on the relative position of the spot to the electronic circuits, are of an optoelectronic nature. These sensors detect the relative angular direction of the spot.

The electronic circuit operates on the motors to maintain the position of the spot constant and frontal to the vehicle. By doing this, the toy follows the spot. The sensors are, for example, photodiodes sensitive to light, for example visible light, in the frequency band of the spot. The sensors detect a spot located in a cone of reception which faces them, they detect the portion of the spot which diffuses in this cone of reception, and generate an electric signal, a current, for example, proportional to the flow detected in this cone. The electronic circuit processes the currents delivered by the sensors and generates the currents of the motor controls accordingly.

According to the present invention, the current of the motors control is proportional to the currents delivered by the diodes, the processing acting like an amplification.

According to an exemplary embodiment of the invention, optimized for sensitivity and the distance taken to detect the spot, the artificial and natural ambient light are eliminated by electronic filtering.

The artificial light environment is characterized by a specific frequency of 100 Hz or 120 Hz, for sample, resulting from the modulations of 50 Hz or 60 Hz of the domestic electrical supply network. The natural light environment is almost constant.

If the sensors have a fast frequency response, particularly like photodiodes, then a filtering can be performed to mask the impact of the ambient light and of the modulation of 100 Hz or 120 Hz, and thus discriminate the spot. An amplitude modulation of the beam, at for example 3 KHz, is particularly adapted to a reception filtering of the same frequency of 3 KHz. According to the present invention, such a filtering ensures a high sensitivity to the detection of the spot in the field of the sensors, in spite of artificial and natural light. This sensitivity is necessary, so that the beam and the spot may be detected in spite of its low power. Ocular safety imposes a beam of very low power, of 0.1 mW maximum. With such a power, the spot presents a luminous power much lower than that of the ambient flow.

BRIEF DESCRIPTION OF THE DRAWINGS

FIG. 1 is a cross-sectional view of an optical remote controller.

FIG. 2 shows an example of an electronic circuit for the remote controller of FIG. 1.

FIG. 9 is a complete schematic of the mechanics of the car.

FIG. 10 describes the processing electronics for the car of FIG. 9.

FIG. 11 illustrates a cross-section of the car of FIG. 9.

FIG. 12 illustrates a modulation of the light of a diode.

FIG. 13 describes corresponding electronics for modulating the light.

FIG. 14 illustrates a configuration to sense and process the light modulation.

FIG. 15 illustrates example sensors signals and the PWM signal for the motors.

FIG. 16 illustrates another exemplary embodiment for optical remote controlling cars.

FIG. 17 shows an alternate circuit combination to process a signal.

DETAILED DESCRIPTION

Figure 3:
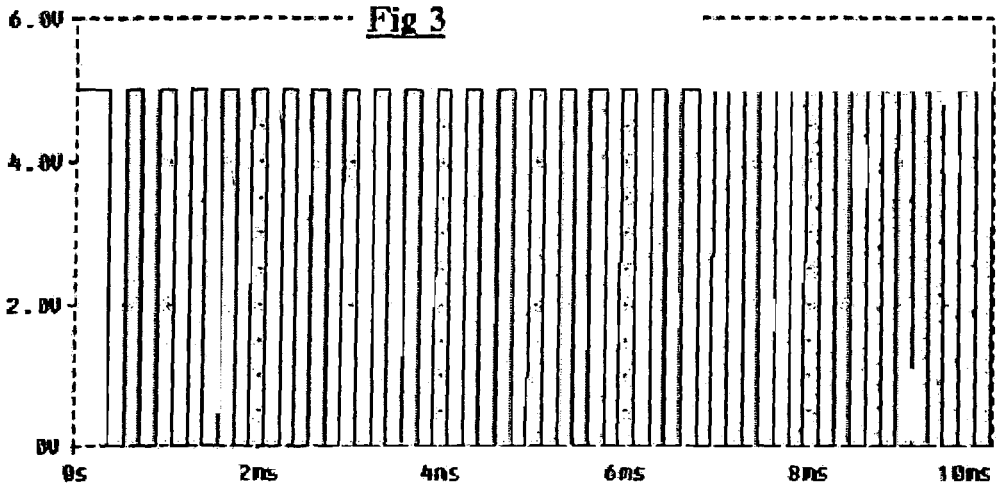
FIG. 3 illustrates the pulse modulation of the light emitted by the remote controller of FIG. 1.

An optical remote control is illustrated in FIG. 1. The optical remote control comprises at least a battery 15 for an autonomous operation, a transmitting diode 13, a lens of collimation 12 and a switch 16. Diode 13 may emit in the visible spectrum, red for example. Blue, green, yellow or white are also appropriate, for example, infrared is also applicable for applications where seeing the beam is not necessary. The diode 13, located approximately at the focal point of lens 12, has its beam concentrated into a parallel beam projecting a spot at a few meters.

An exemplary embodiment of the present invention protects the user from any risk of optical dazzling by guaranteeing that the beam can only be emitted in a ground direction. In this exemplary embodiment, the power supply circuit of diode 13 is closed by a contactor sensitive to the inclination or gravity, like to a ball contactor 17. The contact is closed as soon as the remote controller is tilted downwards. Therefore, facing the beam directly becomes improbable. Such a version of the control sees its ergonomic and its autonomy optimized by a conditioned release. The batteries 15 are preserved from inopportuned use.

According to another exemplary embodiment of the present invention optimized for sensitivity, the intensity of the diode is modulated by the action of an oscillating modulating circuit 14.

Figure 4:
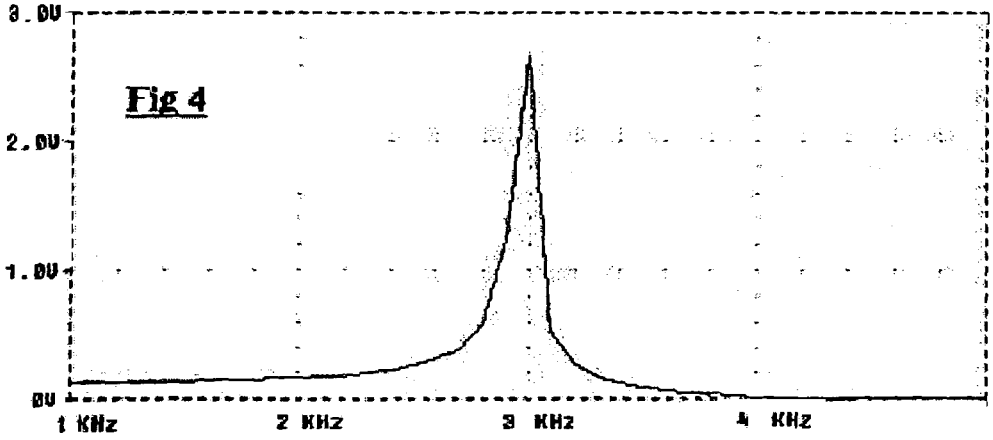
FIG. 4 shows the frequency spectrum of the modulation of the light of FIG. 3.

FIG. 2 schematically represents an exemplary of embodiment of this circuit, wherein FIG. 3 illustrates the output signal of this circuit and FIG. 4 the corresponding spectrum.

In element 24 FIG. 2, the modulator is, for example, made by an oscillating circuit of type 555, regulated by two resistors R1 and R2 and a capacitor C1 which determine the oscillating frequency. A frequency of 3 KHz is, for example, nonexclusive.

In element 23 FIG. 2, the electro-luminescent transmitting diode is controlled by a Mos transistor M1, in element 27 the ball contactor which closes the contact with the inclination to the ground, in element 26 the potentiometer contactor which closes the circuit and controls the mean level of the beam and in element 25 the batteries.

The light intensity varies in proportion to the pressure exerted on trigger 16 FIGS. 1 and 26 FIG. 2.

FIG. 3 illustrates the instantaneous light intensity emitted by the control equipped by modulator 24. It is square modulated at a frequency of 3 KHz as illustrated in the corresponding spectrum in FIG. 4.

Figure 5:
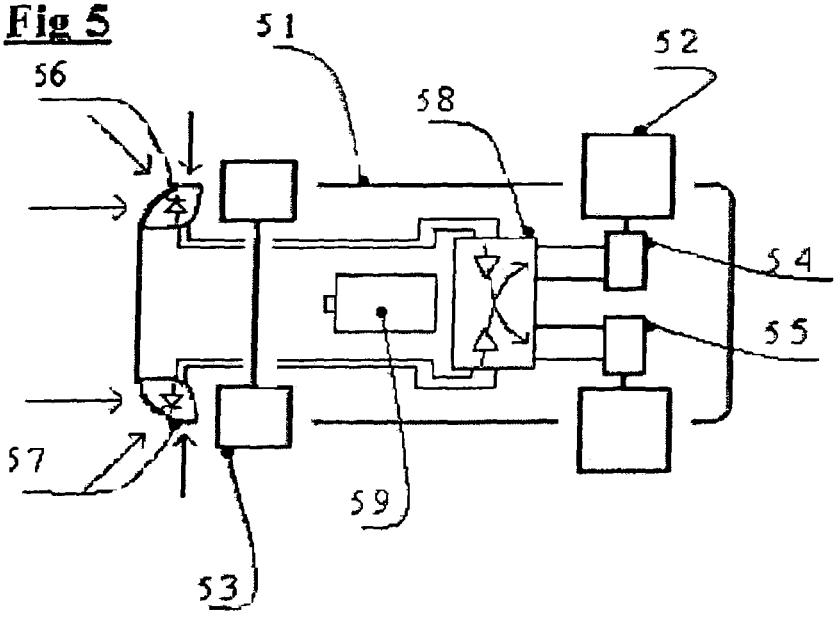
FIG. 5 shows a first exemplary embodiment of the mechanics of a car controlled by the optical remote controller of FIG. 1.

FIG. 5 illustrates an exemplary vehicle embodiment controlled by such a remote control. The vehicle comprises at least two receiving diodes 56 and 57 located in the angles at the front, or inside the cockpit, behind the windows, an autonomous source of energy, like a battery 59, two independent electric motors 54 and 55, each one controlling a wheel 52, and a processing electronic circuit 58.

Motor 54 receives a current or tension of control, which is proportional to the light intensity received on diode 57, this intensity resulting from the presence of a fraction of the spot in the optical field of this sensor.

Motor 55 receives a current or tension of control, which is proportional to the light intensity received on diode 56, this intensity resulting from the presence of a fraction of the spot in the optical field of this sensor. According to the invention, this compensating automatism allows the vehicle to follow the spot.

Figure 6:
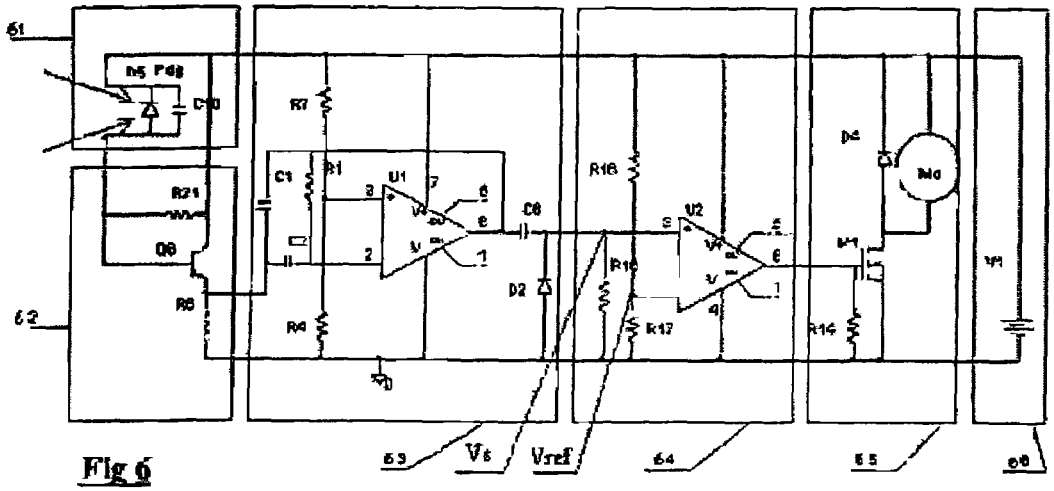
FIG. 6 is a schematic view of the processing electronics of the car of FIG. 5.

A nonexclusive exemplary embodiment of the invention comprises a processing circuit as described in FIG. 6. In a first version, the circuit only comprises elements 61, 65 and 66.

Element 61 represent one of the two receiving diodes, which generates a current proportional to the light intensity received, and element 65 represents the motor on the opposite side. It is traversed by a current proportional to the grid voltage of its control transistor M1. The grid voltage is proportional to the current delivered by 61 in resistor R14. The Md motor in element 65 is thus controlled proportionally to the light received on diode 6, source 66, a battery, provides voltage V1.

In another exemplary embodiment, a preamplifier of current 62 increases the sensitivity of the receiver. That is, for example, provided by a bipolar transistor Q8.

In another exemplary embodiment, only the light modulated at the frequency of modulation of the spot is amplified, for example 3 KHz if that is the modulating frequency of the remote control. The discrimination is performed by a filter set to this frequency in element 63, a filter with a 'Rauch' structure whose band and profits are regulated by resistor R1 in relation to capacitor C1, C2, resistor R6 and finally the operational amplifier U1.

In another embodiment, a second filtering level 64 rejects the frequency of the artificial light, for example 50 Hz, by a simple high pass filtering made by R15 and C6; rectifies the signals at the only frequency of 3 KHz, with the help of diode D2; and finally compares tension Vs to a threshold Vref. From this comparison results a squarewave signal said PWM proportional, which is a traditional control signal for an motor variator without load loss.

Figure 7:
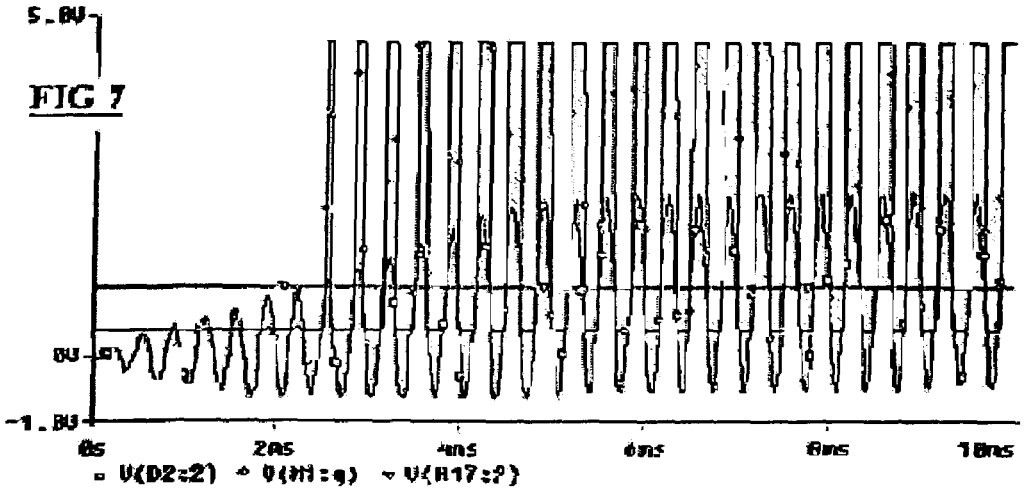
FIG. 7 shows the signal delivered by the sensor and the signal for driving the motor.

The principle is also explained in FIG. 7, which illustrates the PWM control signal (VM1*g*) which has pulses that increase in width as the amplitude of the modulated amplified and filtered signal (VD2:2) goes beyond Vref (VR17:2). This proportional PWM control signal is generated by action of the amplifying comparator U2 which compares Vs to Vref.

Through this combination, a proportional motor control with a weak loss is possible, compatible with batteries whose autonomy are optimized and a weak dissipation by thermal loss in transistor M1.

Figure 8:
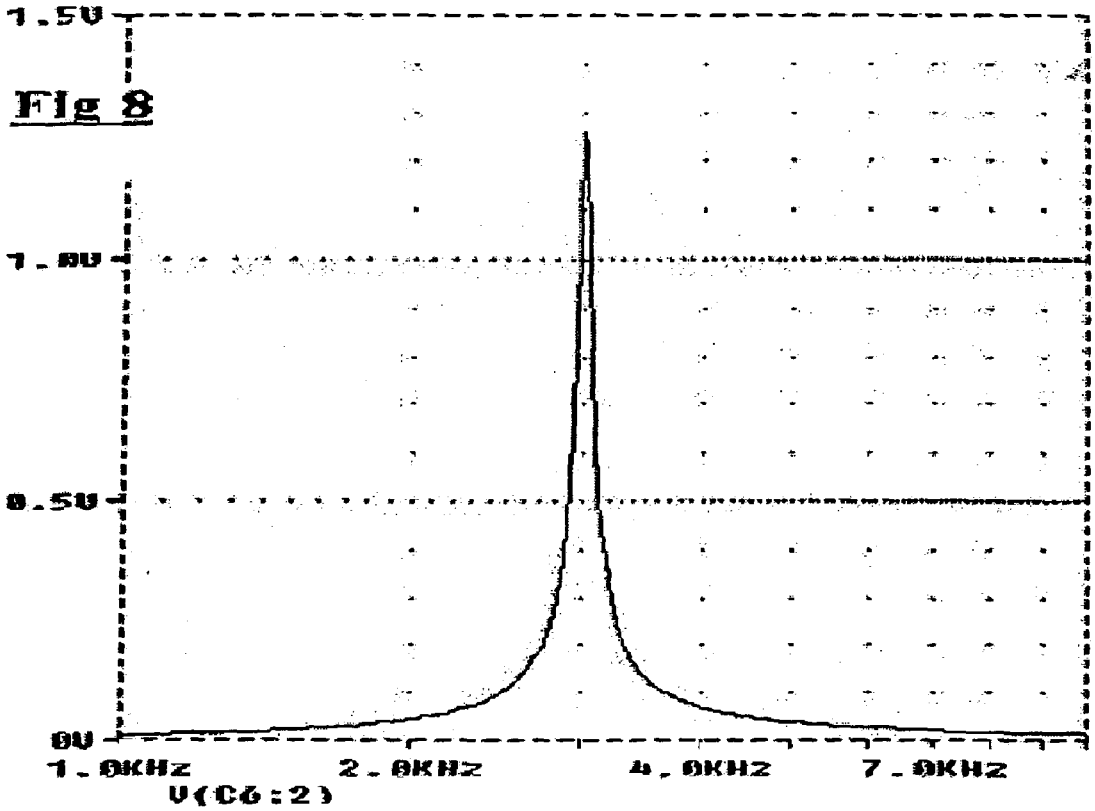
FIG. 8 is a spectrum for the band pass filter of the processing electronics.

The quality factor of the filtering, illustrated in FIG. 8, shows that only the signal modulated at 3 KHz of the light received in 61 is accounted for. Thus, daylight, which is continuous, and electric lightings (100 Hz or 120 Hz) do not have any effect on the motors, the toy has therefore a control which is sensitive and indifferent to the ambient light disturbances.

Any combination of components 62, 63 and 64 is suitable, and is within the framework of the invention. Elements 61, 65 and 66 may be essential and systematic. This describes a first embodiment of the invention, with several versions with increasing sophistication and performances.

In this embodiment, the vehicle only moves forward or turns, therefore, in case of a driving mistake, it can remain blocked by an obstacle. An alternate embodiment of the invention includes a reverse gear control, which may be optically controlled, with one or two additional photoelectric sensors. This is illustrated in FIG. 9, diodes 910 and 911 commanding the reverse gear.

In case a single diode controls the reverse gear, according to the invention, the presence of the beam in the field of the receiver directed on the rear end of the vehicle superposes a current, which is proportional to the detected flow, to the current of two motors 904 and 905. These currents are superposed linearly to the currents resulting from the flows collected on the front diodes.

In case two diodes 910 and 911 sense the rear area, then the motors are controlled in the following manner, as an example:

- motor 905 advances according to the flow received on diode 906 and moves backwards according to the flow received on 911, and
- motor 904 advances according to the flow received on diode 907 and moves backwards according to the flow received on 910.

Through this process, the vehicle is not maintaining itself facing the beam, but exactly under the beam, as the motors are activated to find a balance corresponding to a zero control current. Only the centered position of the vehicle ensures this balance. Through this ergonomic process, the vehicle is guided by the light in all directions, even backwards. It maneuvers automatically to find the correct direction.

FIG. 10 provides an exemplary embodiment of the electronic control 908 of FIG. 9. M FIG. 10 is the motor 905 FIG. 9, and 1001 FIG. 10 is diode 906 FIG. 9 and 1011 FIG. 10 is diode 911 FIG. 9. Only stages 1005 and 1015 FIG. 10 are adapted, according to the principle of H bridges of motor control.

This principle is particularly adapted to the superposition of the forward/reverse controls, which cancel and differentiate themselves without conflict. The motor reacts according to the difference of the signals generated by each amplification chain. Elements 1002, 1003, 1004, 1012, 1013 and 1014 may be optional. The vehicle, according to the invention, may represent any kind of toy. It may traditionally simulate a car, creating an optical remote controlled car. The vehicle can also be derived into a figurine, an animal, etc. For example, a grey mouse may be provided, guided by an infrared beam.

Such a principle of remote control may be a simple and direct drawing mechanism without hard points. Motor systems with reducers do not lend themselves correctly to the use awaited, because of the corresponding clearances and inertias. Indeed, the controls are penalized by any inertia, friction and hard point. Also according to the invention, a simplified mechanism is recommended, according to the illustrated principle in FIG. 11.

A miniature motor 114 with D.C. current like, for example, a "phone vibrator", comprises on its axis a sleeve 115 made out of adherent and elastic material. A rear axle 112 comprises two free wheels on a single shaft and tires made out of adherent and elastic material. A front axle 113 comprises two free wheels on a single shaft and tires made out of rigid and slipping material.

The sleeve draws the wheel 112, which turns freely on its axis. The axis of wheel 112 is guided vertically and with clearance. The weight of the car imposes that the sleeve 115 supports itself on tire 112. As illustrated, the rotation of the sleeve turning in the direction of the arrow causes a self coupling, which reinforces the driving effect. In addition, the motor is not directly engaged with the wheel, it is only coupled when it turns and it is thus protected from shocks.

The moving direction of the vehicle is determined by the relative speeds of the two rear wheels, the front wheels slipping laterally while turning. The system described above advantageously replaces the set of pinions noted in the actual remote controlled cars.

Electro-luminescent diodes with high brightness and high optical quality may be used such as Agilent company red diode HLMP-EGL5-RV000. Collimated with a lens of a 4 cm diameter and a focal distance of 10 cm, it creates a very precise beam and a spot of 5 cm to 3 meters. Model SLID 70 BG2A of the Silonex company or the SLID 70 C2A may be the photo diode. An example of an adapted amplifier is provided by the Microchip Company with the reference MCP602ISN, of the BiMos type. Lastly, the vehicle's power supply may comprise a single battery, associated with a regulating tension elevator of the step-up type, like that of the Maxim brand with the reference max856. For example, the Mos transistor may be FDN335n. The modulator may be model NE555P.

Instead of the electro-luminescent diode 13 in FIG. 1, a laser diode may be used which has a low transmitting level for security of children. An exemplary embodiment may relate to the optimization of the optical filtering realized by a control which emits a modulated infrared beam and by integrated and economic remote control receivers which only receive the modulated infrared light which may directly generate a motor control output signal of type PWM whose width increases with the proximity of the spot.

Another advantage of this exemplary embodiment is that it may use remote control receivers which are industrialized integrated standard components used, for example, for remote control of TV receivers. They are efficient even if the ambient light is bright, have a long range, a low power consumption. According to this exemplary embodiment of the invention, the collimated infrared control beam has a wavelength of about 950 nm, which corresponds to the sensitivity peak of the infrared receivers.

According to this alternative, the control beam is modulated, at a frequency of about 30 to 50 KHz, the frequency band usually used for infrared controls. The power of this modulation carries a signal. The two modulation signals are described in FIG. 12.

The instantaneous power Ic of the infrared beam is the product of a more or less triangular signal 121, which as a frequency of about a few kilohertz, and of a carrier 122, whose frequency is of 30 to 50 KHz, produced by an operator known as a modulator 123.

The control current of the infrared diode D2, according to this principle, is generated according to an economic example of electronic setting described in FIG. 13, by the integrated circuit X1, a NE555, for example, which creates an oscillator whose output signal X1–3 is a squarewave signal whose frequency is determined by resistors R1 and R2 combined with capacitor C1. This output signal controls a chopping transistor of current M1. The modulation signal is generated by another oscillator X2 in combination with its associated components.

The basic tension of the bipolar transistor Q2 restores the shape of the triangular signal, 42 associated with R3 becomes a variable power source, chopped by M1, which controls the current in diode D2. Resistor R7 determines the duration of the high state of the signal, R6 determines the duration of the descent phase, its slope being fixed by the combination of elements C3, R4 and Q2. Resistor R4 fixes the duration of the diode's extinction at the end of the triangle. This generator creates the signal in FIG. 15, which represents an example which is nonexclusive of the control signal.

According to the invention, the infrared remote control receiver integrates, several functions in a single box the following components and functions, illustrated in FIG. 14. In element 141 the receiving infrared diode, in element 142 a preamplifier, in element 143 a limiting amplifier, in element 144 a band-pass filter, in element 145 a rectifying demodulator, in element 146 an integrator, in element 147 a comparator and in element 148 a logical output driver which delivers $\overline{\text{Vout}}$, inverse signal of Vout: the comparator's output.

The band-pass filter 144 is centered on the high modulation frequency, usually between 30 and 50 KHz, at the output of the rectifying modulator 145 and after the integrating filtering by 146, the process reconstitutes the modulation signal 121 of pseudo triangular form and of a 1 KHz frequency, affected of an attenuation coefficient k, which results from the distance between the spot and the receiver. Comparator 147 compares the level of the rectified signal to a reference voltage Vref and controls the logical level of output Vout.

FIG. 15 describes the various signals k,.Ic, Vref and Vout, first, with a spot situated with k small, then with a closer spot, with k larger. This process generates, according to the invention, the equivalent of the processing of the complete chain described in FIG. 6, integrated in a single component.

It delivers a PWM crenel whose width increases with the proximity of the spot. The duration of the high state of the signal, adjusted by R7, is the minimum duration of the PWM pulse which allows the motors to start. By this optimal adjustment, the PWM pulse, corresponding to the detection of the spot at the longest distance, launches the motor to start without a neutral gear. As the spot gets closer, it increases the pulse width and thus the acceleration.

Resistor R4 determines the absence delay of the signal at each period. Respecting a minimum delay is preponderant to the receivers of the cited three companies, because without this delay, the logical level Vout inverses itself when the beam saturates the receiver, which leads to the failure of the control.

The performances of this setting are increased by the use of a carrier and an infrared beam for the following parameters:

insensibility to artificial and natural ambient light, sensibility to a very low powered control beam.

The ambient light is filtered by the box of the component, which only lets through infrareds around 950 nm, for example, and the ambient level variations in the frequencies from 30 to 50 KHz are extremely weak, and thus do not disturb the reception of the control signal.

According to the invention, this alternative is implemented by substitution of the electronic circuit described in FIG. 6 and FIG. 10 by the infrared receivers, and substitution of the emitter's electronic in FIG. 2 by that of FIG. 13. Infrared remote control receivers, as those of the Sharp, Kodenshi, JRC etc Companies, which are compact may be used.

The logical output Vout controls a branch of the H bridge, which has two Mos transistors, as described previously. A second exemplary embodiment and setting provides an adaptation of the principle to miniature cars, which have rear end propulsion that is ensured by a single motor 161 and direction by swivelling wheels. It is described in FIG. 16.

Accordingly, the orientation is ensured by a set of rods 162. These rods are driven either by a motor 163 and a toothed rack interdependent of 162, or by an electromagnet 164 and magnets interdependent of 162. This embodiment is compatible with the setting of a remote control emitting a spot to be followed.

The receivers being distributed at the 4 corners of the car, in logical state 1 without spot, a logical combination of their output generates a PWM motor control adapted to this particular mechanic.

The logical combination is described in FIG. 17, it generates the following logical equations:

1) The front right receiver or the rear left receiver controls the orientation of the front wheels to the right.
2) The front left receiver or the rear right receiver controls the orientation of the front wheels to the left.
3) The front right or front left receivers control the propulsion of the car forward.
4) The rear right or rear left receivers control the reverse motion of the car.

The conflicts are managed without incident like uncontrolled static states. According to this logic, created very simply with a low state receiver in light reception, high state out light reception, simple diodes combine the H bridge control of the motors and of electromagnet.

Thanks to the PWM principle, the controls are progressive, which brings a progressive orientation and acceleration. It constitutes a very clear progress compared to the skill of the art of the controls, whose behavior is often binary, for example: full acceleration or stopped, straight on the right or straight on the left.

The optically generated PWM allows a precise orientation in all the intermediate directions.

According to the invention, this type of vehicle with 4 receivers detects the beam in a range of 20 to 40 cm around and automatically generates the succession of maneuvers necessary to come and place itself under the beam. It realizes an advanced automatism, which uses a vectorial analogical slave control.

The below is an example of successive maneuvers which may be conducted:

Initial state: Spot located in front and on the right of the car

Wheels directed to the right, the motor advances.

The car goes beyond the spot and leaves it on its right.

Wheels turn to the left, the motor reverses.

The car faces the spot.

The car advances and goes slightly beyond the spot.

It then reverses and places itself exactly below, where the level is equivalent on the 4 sensors.

According to the invention, the automatism made it possible to generate the 4 minimum successive maneuvers to reach the spot without any intervention of the user, the spot having remained motionless. When the user moves the spot in front of the car, the car follows the spot, the orientation resulting from the balance search between the front receivers, and the acceleration resulting from the imbalance between the front and rear receivers.

Another exemplary embodiment of the invention concerns the visualization of the pointing beam. This visualization is educational wherein it enables the tracking of the spot and is desirable for young children.

Figure 18:
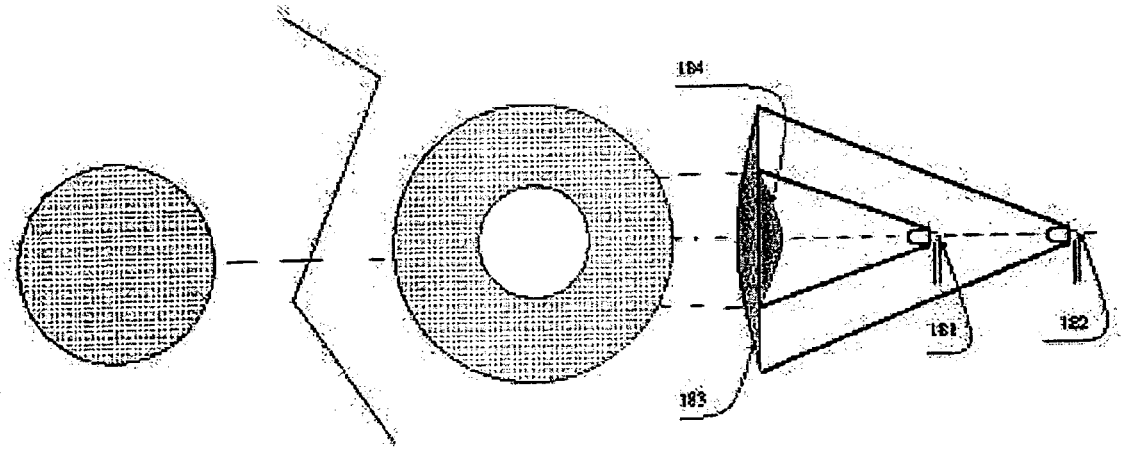
FIG. 18 shows a generation of a spot.

The use of an infrared control, while being powerful, may be opposed based upon economic considerations. A complementary optic solves this problem and is illustrated in FIG. 18. It comprises a double optic, bifocal, for example made out of two coupled lenses 183 and 184, or out of a single moulded optic. The infrared transmitting diode 181 may be placed at the focal point of the central area, a visible diode 182, red, green, blue or yellow is placed at the second focal point. Two opaque cones separate the visible and invisible beams.

According to this alternative, the visible beam at the output of the optic is annular, and at the end of the control range, the beam becomes a compact spot.

According to the invention, the car follows the center of the modulated infrared beam, i.e. the center of the visible ring. The simple addition of the visible diode and its complementary optic optimizes the economy without degrading the piloting accuracy. According to the invention, in this case, the visible diode is powered by a D.C. current.

Figure 19:
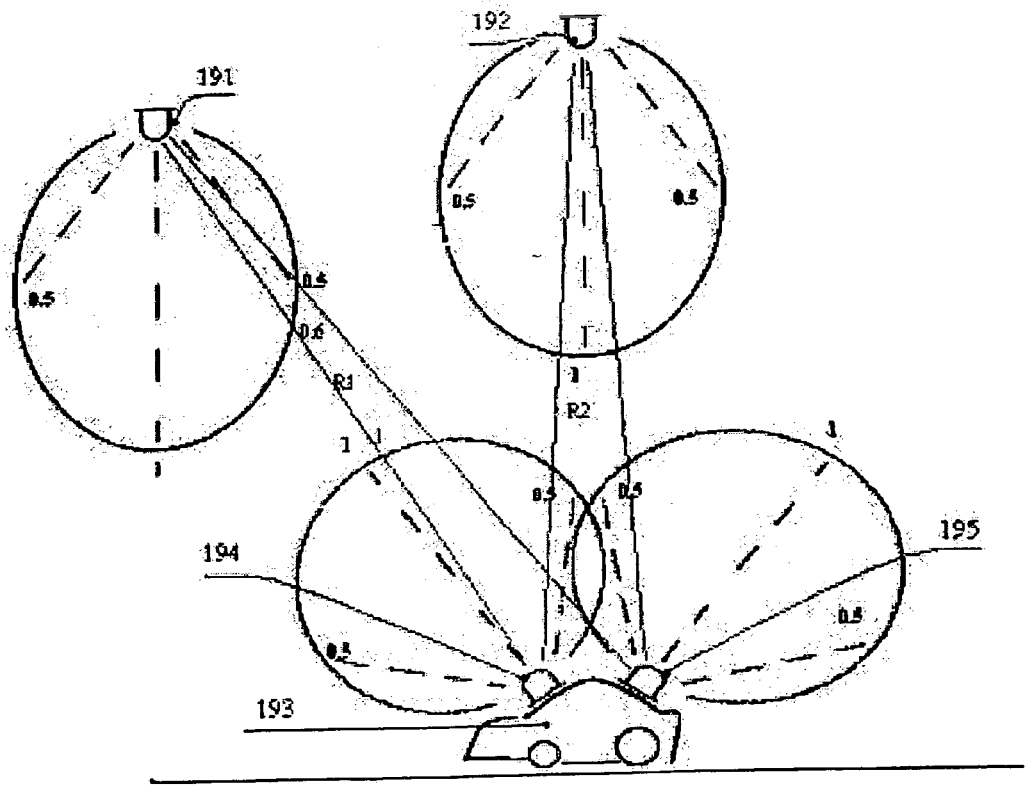
FIGS. 19 and 20 describe another exemplary embodiment of optoelectronic parts.
Figure 20:
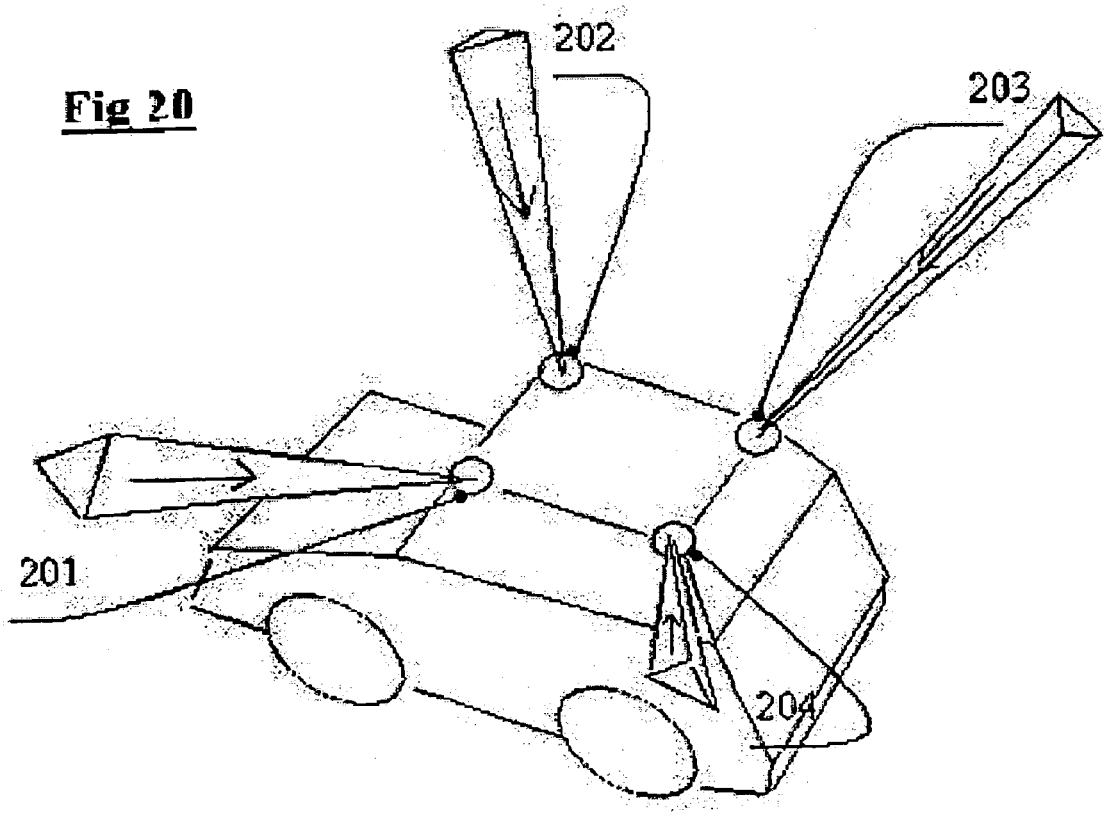

A last exemplary embodiment described in FIG. 19 and FIG. 20, concerns the realization of a coarse, simplified and economic control. In this embodiment, the vehicle does not follow a spot projected on the ground, but the source of a beam which diffuses towards the ground according to a broad field.

The source is, for example, made up of a simple infrared encapsulated diode, diffusing towards the ground according to a cone of +/−30°. It is modulated according to one of the processes described before. According to the configuration, it can be integrated onto a key ring, a belt, a bracelet, etc.

According to this alternative, the receivers of the vehicle are located at the 4 corners, or on the roof, and therefore point upwards in 4 centrifugal directions, FIG. 20.

FIG. 19 illustrates two positions 191 and 192 of the transmitting control diode, on top of vehicle 193, including two receiving diodes or two infrared remote control receivers 194 and 195 which point upwards.

The level received on each receiver is determined by the product of diffusion of the transmitter and of the receiver, it is geometrically measured on the diffusion graph, multiplied by the inverse of the distance between the transmitter and the receiver squared.

For couple 191, 194, $k=0.5\times1/R1^2$

For couple 191, 195, $k=0.5\times1/R1^2$

For couple 192, 194, $k=1\times0,5/R2^2$

For couple 192, 195, $k=1\times0,5/R2^2$

In the light of the former elements of the description, the position of the transmitter in 191 starts a reception of higher level on the front receivers, 194 for example, which starts the vehicle forward.

In the same manner, position 192 starts a level of reception equivalent on the front and rear receivers, 194 and 195, the vehicle stops.

According to the same automatism previously described, this geometry organizes the tracking of the transmitter, the vehicle placing itself below, in the position which balances the levels received for the various receivers.

The receivers are preferably integrated remote control receivers and the transmitter an infrared diode without optics of collimation, with a more or less broad field of diffusion. The diode may be controlled by a current as described in FIG. 12. The toy can be, for example, an animal which permanently follows the child, who carries a key ring transmitter at his belt, the remote control process being as a virtual lead.

Figure 21:
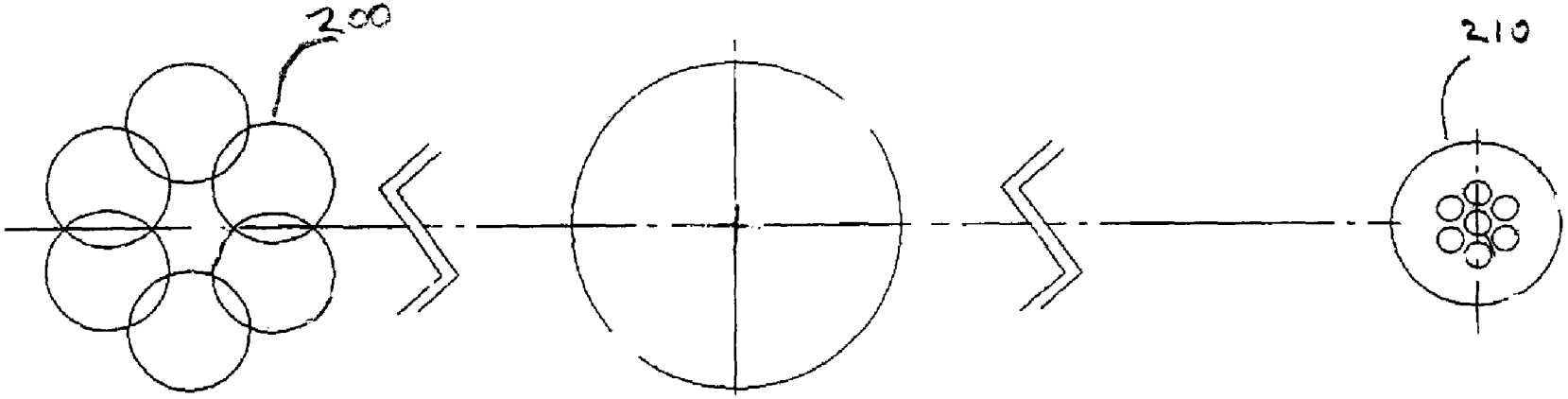
FIG. 21 is a plan view of a spot at long and short ranges.

Referring to FIG. 21, the controller may also be configured such that the user may select the type of control desired for the vehicle. In an exemplary embodiment, the controller can be configured to control the vehicle through an infrared mode. The user may then decide on whether a visible spot is created to aid the user in identification of the infrared spot. The selection of whether the visible spot is created may be determined through pressure placed upon the controller by the user. The selection may also be made through actuation of separate buttons on the controller. The visible spot may be configured such that at close range 200, the visible spot has an approximately similar size as the infrared spot. At longer ranges 210, the visible spot may be configured to be a ring, with the infrared spot located in the center of the ring.

Figure 22:
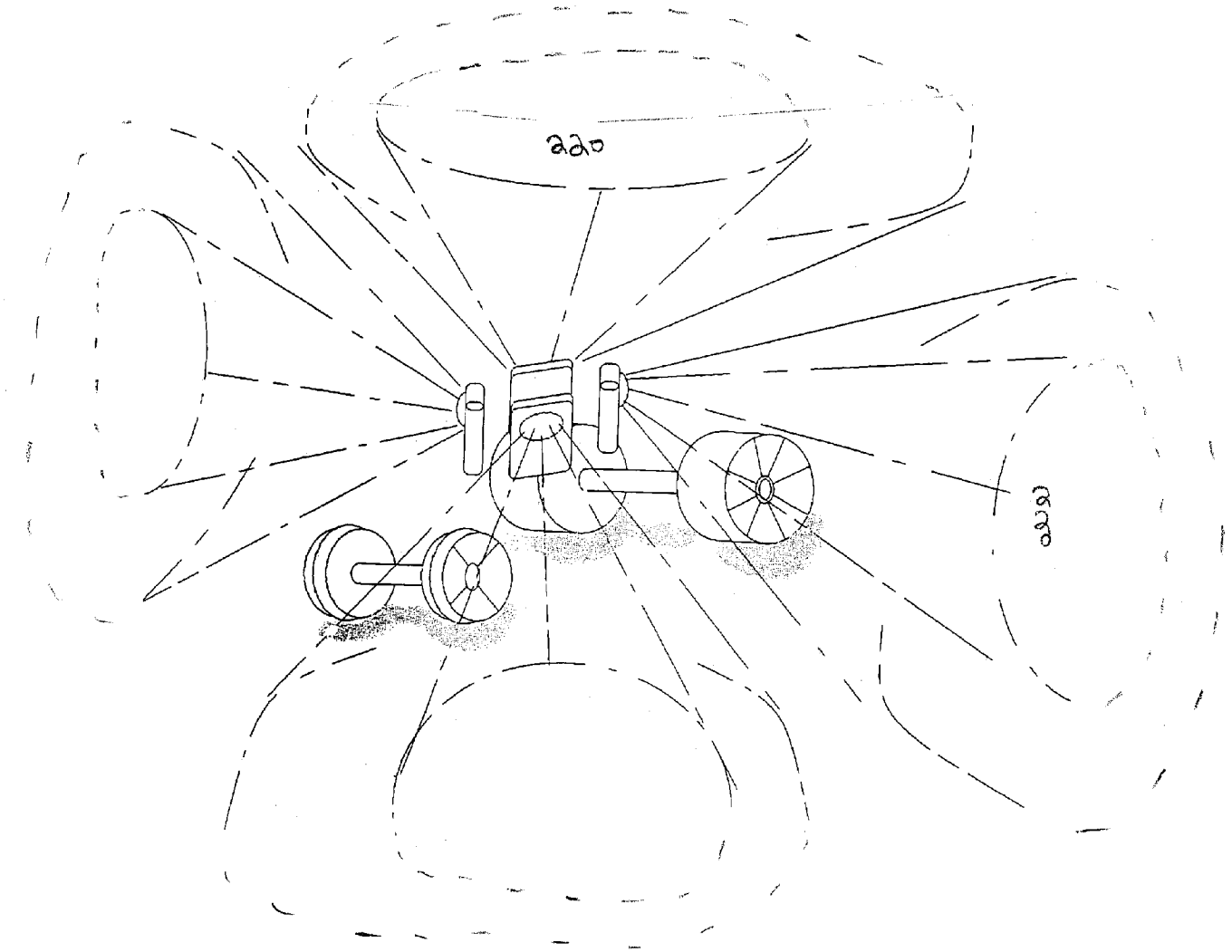
FIG. 22 is a side perspective view of a vehicle with sensors receiving information.

Referring to FIG. 22, a vehicle is illustrated receiving information through the sensors located at a top of the vehicle. The sensors can be configured to receive information from defined areas 220. As illustrated, the sensors may be positioned to receive signals at the corners of the vehicles. Other configurations are also possible. The application field of the invention can be applied to any of the combinations of the elements described, without limits.

What is claimed is:

1. A motorized mobile toy comprising:

four wheels;

a remote controller which has a light source which emits, in a ground direction, a light beam which is modulated at a frequency above a domestic light frequency modulation, the remote controller configured to generate a spot on a ground surface through a lens of collimation that focuses light from a light source generated by a transmitting diode;

at least two optoelectronic sensors which are disposed on two opposite front sides of the toy, wherein reception fields of the sensors are oriented towards the ground surface and the sensor are each configured to deliver a control signal substantially proportional to an intensity of a flow of the modulated light which is received in the respective reception field; and at least one electric motor configured to receive the control signals and drive one wheel of the toy at a substantially proportional speed to the intensity of the flow of the modulated light received in the respective reception field, wherein a difference of the control signals delivered by two of the at least two optoelectronic sensors controls a steering of the toy on a side of the optoelectronic sensor which delivers a greater control signal and a sum of the control signals delivered by two of the at least two optoelectronic sensors controls a driving forward of the toy so that the toy follows and reaches the spot on the ground surface.

2. The motorized mobile toy according to claim 1, wherein the toy comprises two motors, a first motor driving a left wheel and a second driving a right wheel and two optoelectronic sensors, a left sensor controlling a right motor forward and a right sensor controlling a left motor forward.

3. The motorized mobile toy according to claim 1, wherein the toy comprises one motor which drives one wheel, an opposite wheel being free, and wherein both other wheels are configured to swivel together under a control of a steering system which is controlled by the difference of the control signals such that the wheels are configured to swivel together swivel to a side of the optoelectronic sensor which delivers a greater control signal and wherein the motor is controlled by the sum of the signals of the optoelectronic sensors.

4. The motorized mobile toy according to claim 2, further comprising:

two optoelectronic sensors which are arranged on two opposite rear sides of the toy, wherein each rear optoelectronic sensor controls a backward driving of the motor which is disposed on a same side as the respective optoelectronic sensor.

5. The motorized mobile toy according to claim 2, further comprising:

one optoelectronic sensor which is arranged on a rear side of the toy, wherein the rear optoelectronic sensor controls a backward driving of the two motors.

6. A motorized mobile toy according to claim 1, wherein the motor is controlled proportionally without loss of load, wherein a processing electronic circuit is configured to deliver width modulated pulses with widths that are substantially proportional to an intensity of the flow received by the optoelectronic sensors.

7. A motorized mobile toy according to claim 6, further comprising:

a processing electronic circuit configures to amplify and filter the optoelectronic signals at a fixed frequency and then compare "the signals" or "the sum of the signals" to a reference voltage and deliver width moderated pulses, and wherein the remote controller is configured to generate light pulses at a fixed frequency.

8. The motorized mobile toy according to claim 6, further comprising:

a processing electronic circuit configured to amplify and filter the optoelectronic signals at a fixed high frequency and then rectify "the signals" or "the sum of the signals" and compare "the signals" or "the sum of the signals" to a reference voltage and deliver the width moderated pulses, wherein the remote controller is configured to generate light pulses at a fixed high frequency with an amplitude varying at a lower frequency.

9. The motorized mobile to according to claim 1, wherein the remote controller is configured to generate one modulated beam of infrared light for controlling the toy and a coaxial beam of visible light for indicating a position of the spot.

10. The motorized mobile toy according to claim 1, wherein the remote controller further comprises:

a light source constituted by a lens collimating one of a light emitting diode and a laser diode.

11. The motorized mobile toy according to claim 1, wherein the remote controller comprises a switching arrangement which is configured to sense an arrangement orientation and to stop the emission of the modulated light beam, when remote controller is not directed to the ground.

12. The motorized mobile toy according to claim 1, wherein an axle of the at least one electric motor is configured with a sleeve which is rolling on the wheel and drives the wheel.

13. A motorized mobile toy comprising:

a movement arrangement;

a remote controller which has a light source which emits, in a ground direction, a light beam which is modulated at a frequency above a domestic light frequency modulation, the remote controller configured to generate a spot on a ground surface through a lens of collimation that focuses light from a light source generated by a transmitting diode;

at least two optoelectronic sensors which are disposed on two opposite front side of the toy, wherein reception fields of the sensors are oriented towards the ground surface, and the sensors are each configured to deliver a control signal substantially proportional to an intensity of a flow of the modulated light which is received in the respective reception field; and at least one electric motor configured to receive the control signals and drive one section of the movement arrangement of the toy at a substantially proportional speed to the intensity of the flow of the modulated light received in the respective reception field wherein a difference of the control signals delivered by two of the at least two optoelectronic sensors controls a steering of the toy on a side of the optoelectric sensor which delivers a greater control signal and a sum of the control signals delivered by two of the at least two optoelectronic sensors control a driving forward of the toy so that the toy follows and reaches the spot on the ground surface.

14. The motorized mobile toy according to claim 13, wherein the mobile toy is shaped like an animal that has at least two legs.

15. The motorized mobile toy according to claim 13, wherein the mobile toy is shaped like a figurine.

16. The motorized mobile toy according to claim 13, wherein the mobile toy is shaped like a mouse.

17. The motorized mobile toy according to claim 13 wherein the mobile toy is shaped like an animal.

* * * * *